US008809660B2

(12) United States Patent
Osuga et al.

(10) Patent No.: US 8,809,660 B2
(45) Date of Patent: Aug. 19, 2014

(54) KEYBOARD DEVICE FOR ELECTRONIC MUSICAL INSTRUMENT

(71) Applicant: Yamaha Corporation, Hamamatsu (JP)

(72) Inventors: Ichiro Osuga, Hamamatsu (JP); Kenichi Nishida, Hamamatsu (JP); Shunsuke Ichiki, Hamamatsu (JP); Hiroshi Harimoto, Hamamatsu (JP); Shin Yamamoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/769,245

(22) Filed: Feb. 15, 2013

(65) Prior Publication Data

US 2013/0205974 A1 Aug. 15, 2013

(30) Foreign Application Priority Data

Feb. 15, 2012 (JP) ..... 2012-030417

(51) Int. Cl.
*G10C 3/12* (2006.01)

(52) U.S. Cl.
USPC ..... 84/439

(58) Field of Classification Search
USPC ..... 84/423 R, 430, 433–439, 3, 24–26
See application file for complete search history.

(56) References Cited

U.S. PATENT DOCUMENTS

| | | | | |
|---|---|---|---|---|
| 2004/0003708 A1 | 1/2004 | Buchla | | |
| 2008/0066608 A1 | 3/2008 | Osuga | | |
| 2008/0163741 A1* | 7/2008 | Ishihara et al. | | 84/435 |
| 2010/0326257 A1* | 12/2010 | Yaguchi et al. | | 84/687 |
| 2011/0005370 A1 | 1/2011 | Kitajima | | |

FOREIGN PATENT DOCUMENTS

| | | | | |
|---|---|---|---|---|
| JP | 04-347895 A | | 12/1992 | |
| JP | 04-347896 A | | 12/1992 | |
| JP | 04-350697 A | | 12/1992 | |
| JP | 05-090586 U | | 12/1993 | |
| JP | 07230270 A | * | 8/1995 | G10D 13/02 |
| JP | 08-076756 A | | 3/1996 | |
| JP | 08-106281 A | | 4/1996 | |
| JP | 11352955 A | * | 12/1999 | G10D 13/02 |
| JP | 3074794 B2 | | 8/2000 | |
| JP | 2005-010418 A | | 1/2005 | |

OTHER PUBLICATIONS

European Search Report mailed Oct. 4, 2013, for EP Application No. 13155012.1, nine pages.

* cited by examiner

*Primary Examiner* — Kimberly Lockett
(74) *Attorney, Agent, or Firm* — Morrison & Foerster LLP

(57) ABSTRACT

A keyboard device includes hammers 16*w*, 16*b* that rock with the rocking movement of plural white and black keys 11*w*, 11*b*. The plural white and black keys 11*w*, 11*b* include drive units that drive the hammers 16*w*, 16*b*. The drive unit is provided on a front end of the key. A positional relationship between a plane including a key support portion of each white key 11*w* and black key 11*b* and the front end of the white key 11*w* and black key 11*b*, and a top face of each white key 11*w* and black key 11*b* is set such that the top faces of the plural white keys 11*w* and black keys 11*b* are located on the same plane, when the rocking angles of the plural white keys 11*w* and black keys 11*b* reach a predetermined angle respectively.

10 Claims, 8 Drawing Sheets

KEYBOARD DEVICE FOR ELECTRONIC MUSICAL INSTRUMENT

BACKGROUND OF THE INVENTION

1. Field of the Invention

The present invention relates to a keyboard device for an electronic musical instrument such as an electronic organ, an electronic piano, and the like.

2. Description of the Related Art

There has conventionally been known a keyboard device for an electronic musical instrument described in Japanese Patent No. 3074794. In this keyboard device described above, a key touch feeling (reaction force against a key depression/release operation) on a front end of a key, to which a higher pitch is assigned, is set lighter in order to generate a key touch feeling similar to a key touch feeling of an acoustic piano. This keyboard device has plural hammers, each of which rocks through an engagement with the corresponding key so as to apply reaction force against the depression/release operation of the corresponding key. The plural hammers are common components. In this keyboard device, the length from the pivot point of the key, formed on a back end, to the front end of the key becomes gradually longer toward the keys on the high-pitched side from the keys on the low-pitched side. In addition, the position of the pivot point of each hammer is gradually shifted backward from the low-pitched side toward the high-pitched side, by which the distance from the pivot point of the key to the engagement position between the hammer and the key is set to be the same for all keys.

The conventional keyboard device described above has a stopper for restricting the rocking movement of the key, and the maximum depth during the key depression is the same for all keys. However, since the pivot point of each hammer is shifted in the longitudinal direction, the range of the rocking angle of each hammer is different among the assigned pitches. Therefore, it is necessary to set the position and performance of a rubber switch, which is pushed by the rocking movement of the hammer, to be different among the assigned pitches. In order that the height of the front end of each key and the tilt angle of each key during the key release and the key depression are set to be the same for all keys to make the appearance of the keyboard device similar to the appearance of an acoustic piano, the position and thickness of the stopper for restricting the rocking movement of each key have to be different among the assigned pitches. Accordingly, a large variety of components are needed, so that the productivity of the keyboard device is low.

SUMMARY OF THE INVENTION

The present invention is accomplished to solve the above-mentioned problem, and aims to reduce cost for the keyboard device, which creates a key touch feeling and appearance similar to those of an acoustic piano by shifting the position of the pivot point of each key in the longitudinal direction, and to enhance productivity of the keyboard device. For easy understanding of the present invention, a numeral of a corresponding portion in an embodiment is written in a parenthesis in the description below of each constituent of the present invention. However, each constituent of the present invention should not be construed as being limited to the corresponding portion indicated by the numeral in the embodiment.

In order to attain the foregoing object, the present invention provides a keyboard device for an electronic musical instrument, the keyboard device including: plural white keys and black keys (11*w*, 11*b*) that are supported by a key support portion (Kw, Kb) in order that front ends thereof rock in the vertical direction by a key depression/release operation by a performer, each white key having an edge line extending in the longitudinal direction on a crossing portion of a side face and a top face, and each black key having an edge line extending in the longitudinal direction on a crossing portion of a lower side face and an upper side face tilting inward with respect to the lower side face, wherein a pitch is assigned to each of the plural white keys and black keys, each of plural white keys and each of black keys include an operation portion that is depressed and released by the performer, and a drive unit (11*w*1, 11*b*1) extending downward on a front end of the operation portion, and a length from the front end of the operation portion to the key support portion is different among the plural white keys and black keys; plural hammers (16*w*, 16*b*), each of which includes an engagement portion engaged with the drive unit of each of the plural white keys and the drive unit of each of the plural black keys, and each of which is supported by a hammer support portion (Hw, Hb) in order to rock with the rocking movement of each of the plural white keys and black keys; and a restricting member (20, 21) that is arranged to extend in the direction of the arrangement of the plural white keys and black keys, and that restricts the rocking movement of the plural hammers in order to restrict the rocking range of the plural white keys and the plural black keys, wherein, when a first key out of the plural white keys and the plural black keys and a second key having the distance longer than the distance of the first key have a predetermined rocking angle respectively, the first key and the second key being both white keys or both black keys, a positional relationship between a plane including the key support portion of the first key and the front end of the operation portion of the first key, and the top face of the first key is set in order that the position of the front end of the operation portion of the first key in the vertical direction and in the longitudinal direction is the same as the position of the front end of the operation portion of the second key in the vertical direction and in the longitudinal direction, and the top face of the first key is in plane with the top face of the second key. In a state in which braking force for stopping the hammer by the restricting member is transmitted via the engagement portion between the key and the hammer, it is regarded that the rocking movement of the key is substantially restricted by the restricting member of the hammer.

In this case, it is preferable that the key support portion of the first key is located below a reference plane (S1, S3) including the key support portion of the second key and the front end of the second key in the state in which the second key is released, and when the first key and the second key are released, the front end of the operation portion of the first key is located posterior to the front end of the operation portion of the second key.

In this case, it is preferable that the first key and the second key are adjacent white keys, and the edge line of the black key between the first key and the second key is located between the top face of the first key and the top face of the second key, in a state in which the first key, the second key, and the black key are released.

In this case, it is preferable that the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted. The state in which the rocking movement is restricted means the state in which the same load is applied to the front end of the white key and the front end of the black key to restrict the rocking movement of the keys. The present invention includes the case in which a part of the edge line of the black key on the front end is located below the top face of the first key and the top face of the second key.

In this case, it is preferable that the distance from the leading end to the hammer support portion of the plural hammers is the same for all of the plural hammers. Each of the plural hammers includes a mass member that becomes light from a low-pitched side toward a high-pitched side, and a key touch feeling becomes gradually light from the low-pitched side toward the high-pitched side. The mass member for the hammer for the white key is heavier than the mass member for the neighboring hammer for the black key. The length from the front end to the back end of the plural white keys becomes shorter toward the high-pitched side from the low-pitched side, and the length from the front end to the back end of the plural black keys becomes shorter toward the high-pitched side from the low-pitched side.

According to the keyboard device configured as described above, the appearance can be made close to the appearance of a keyboard on an acoustic piano without a need to adjust the height of the front end of the key for each key in the key released state and the key depression state. Therefore, the number of components can be reduced, compared to the case where the height of the front end of the key is adjusted for each key, whereby the cost for the keyboard device can be reduced. When the plural white keys and the black keys are depressed, and their rocking movement is restricted, in particular, the top face of the white key and the top face of the black key are located on the same plane, resulting in that the present invention can generate the appearance similar to the appearance of the acoustic piano in the key depression state. The rocking angle is an angle of the plane including the edge line of the key with the key released state being defined as a reference. The front end of the operation portion of the key from which the drive unit extends is a region where at least a part of a region on which the front end of the key passes when the key rocks and a part of a region on which the engagement portion between the drive unit and the hammer passes are superimposed in the longitudinal direction as viewed in a plane.

Another aspect of the present invention is that the distance between the plane including the edge line of the first key and the key support portion of the first key is set to be the same as the distance between the plane including the edge line of the second key and the key support portion of the second key. In this case, it is preferable that the positions of the key support portion of the first key and the key support portion of the second key are set to be the same. By virtue of this configuration, the part other than the part involved with the length of the key can be the same as much as possible. In addition, the support member (frame) for supporting the key can easily be designed. The support member is easily processed, whereby precision can be enhanced. When the distance between the plane including the edge line of the first key and the key support portion of the first key is set to be the same as the distance between the plane including the edge line of the second key and the key support portion of the second key, and the positions of the key support portion of the first key and the key support portion of the second key are set to be the same, the top face of the first key and the top face of the second key are located on the same horizontal plane in the key depression state. Consequently, the appearance similar to the keyboard of the acoustic piano can be generated.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

One embodiment of the present invention will be described below with reference to the drawings. In the description below, a side close to a performer is defined as a "front side", while a side far from the performer is defined as a "rear side". A high-pitched side is defined as a "right side", while a low-pitched side is defined as a "left side".

Figure 1:
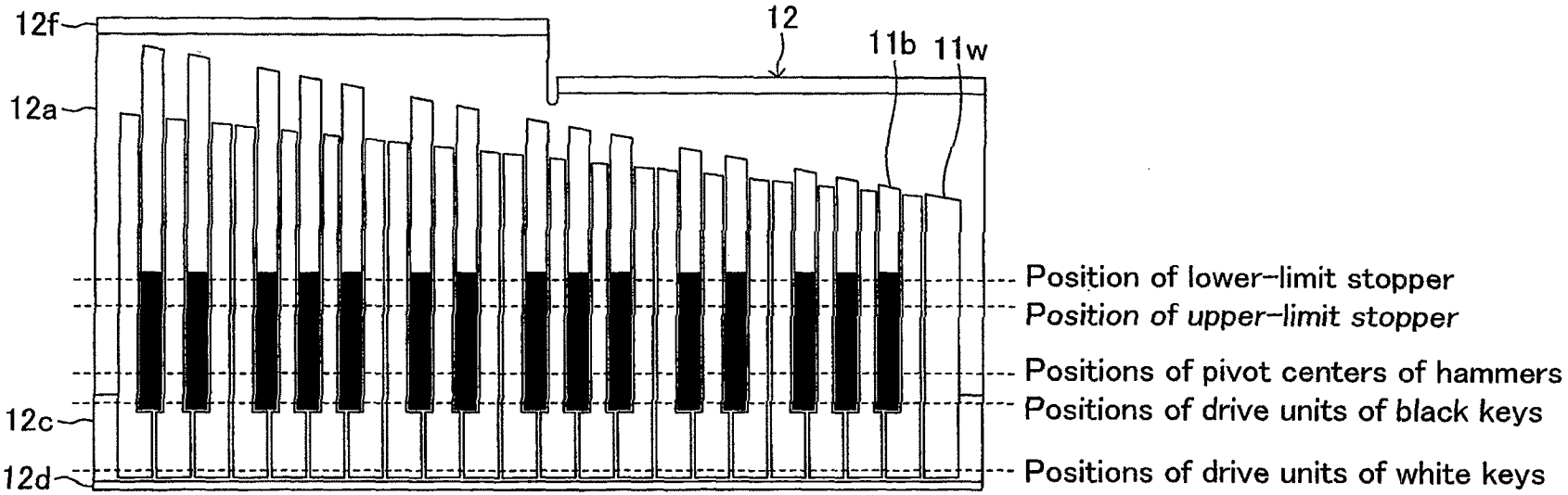
FIG. 1 is a plan view illustrating a keyboard device according to one embodiment of the present invention.
Figure 2:
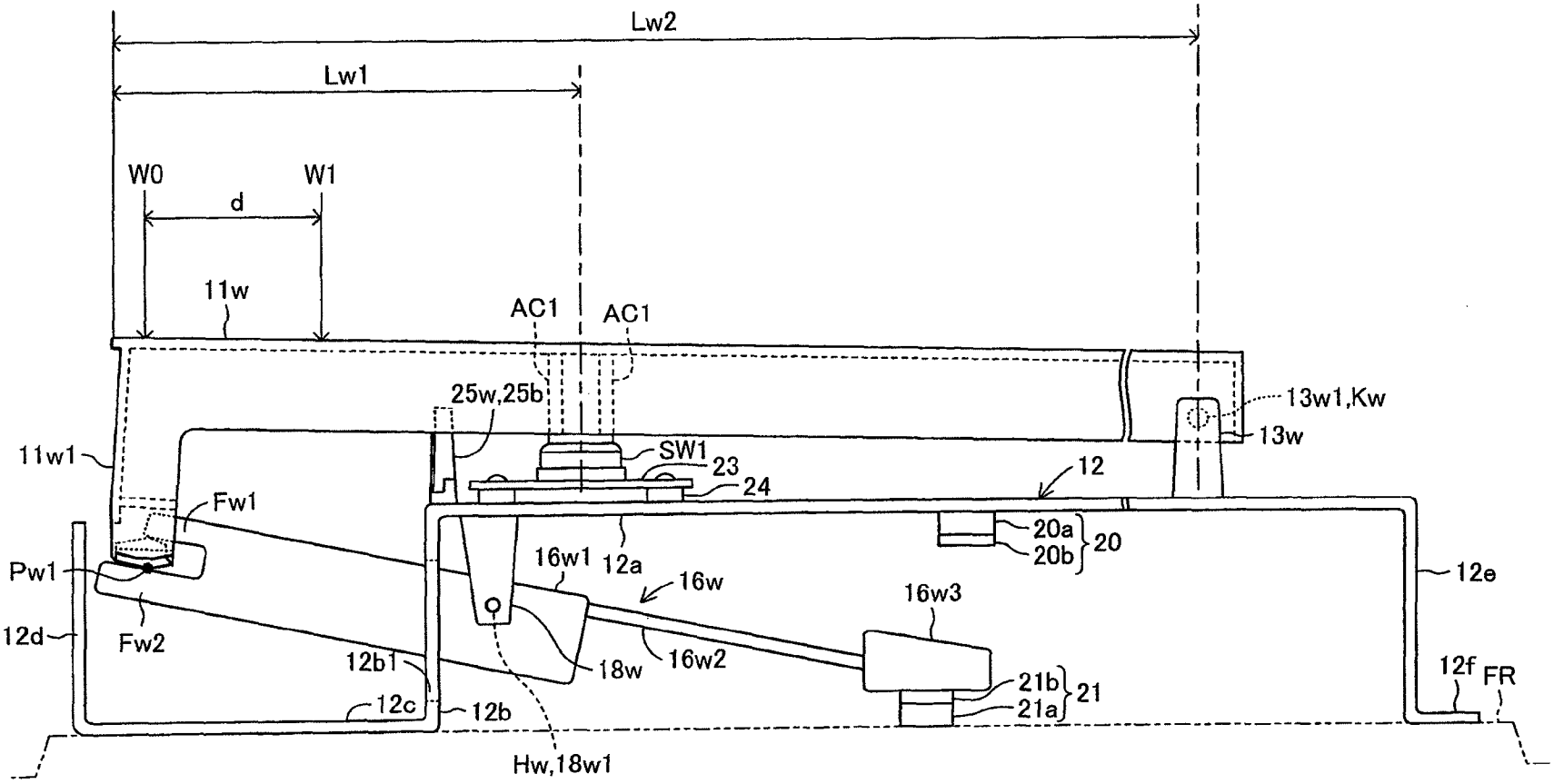
FIG. 2 is a right side view illustrating a configuration of a white key in the keyboard device illustrated in FIG. 1.
Figure 3:
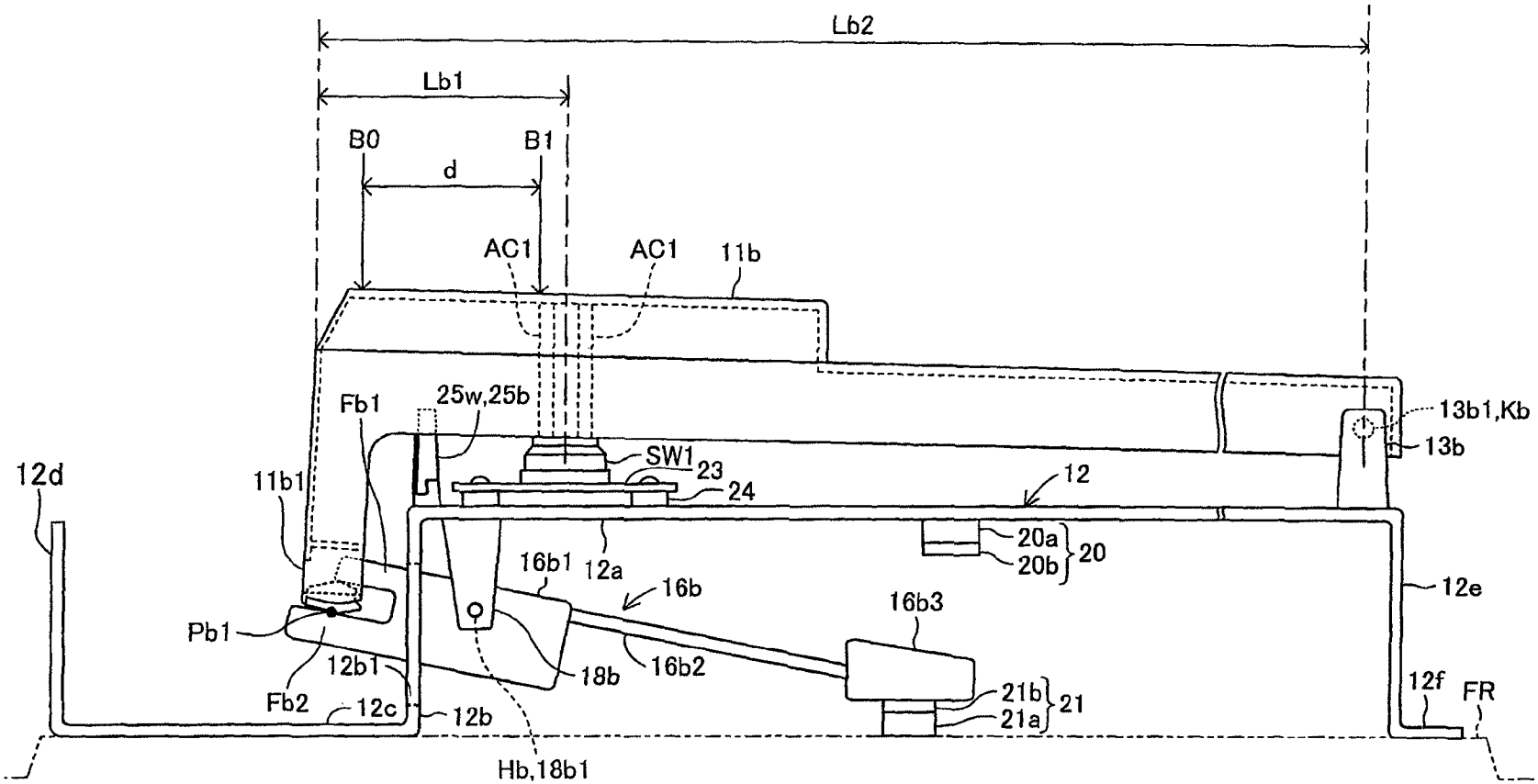
FIG. 3 is a right side view illustrating a configuration of a black key in the keyboard device illustrated in FIG. 1.

A keyboard device includes plural white keys 11*w* and plural black keys 11*b* as illustrated in FIGS. 1 to 3. A different pitch is assigned to each of plural white keys 11*w* and each of plural black keys 11*b*. In the present embodiment, one of "C3", "D3", . . . "C6" is assigned to the white keys 11*w*, while one of "C#3", "D#3", . . . "B#5" is assigned to the black keys 11*b*. The white keys 11*w* and black keys 11*b* are integrally formed to have a long shape by a synthetic resin. The white keys 11*w* are configured such that the length thereof is gradually shorter toward the white key 11*w* on the high-pitched side from the white key 11*w* on the low-pitched side. The black keys 11*b* are configured such that the length thereof is gradually shorter toward the black key 11*b* on the high-pitched side from the black key 11*b* on the low-pitched side. The back end of the black key 11*b* is located posterior to the back end of the adjacent white key 11*w*.

The white keys 11*w*, each having a different assigned pitch, have different length in the longitudinal direction, but the other structures are the same. The black keys 11*b*, each having a different assigned pitch, have different length in the longitudinal direction, but the other structures are the same. Each of the white keys 11*w* has a width in the vertical direction smaller than that of the black key 11*b*, and has a width in the lateral direction larger than that of the black key 11*b*. The white key 11*w* and the black key 11*b* have a hollow shape including a thin top wall extending in the longitudinal direction, and thin sidewalls extending downward from left and right ends of the top wall respectively, with no bottom.

Through-holes Kw and Kb that are opposite to each other are formed on the rear part of the sidewall of the white key 11*w* and the black key 11*b*. The distance from the through-holes Kw and Kb to the back end of each key is the same for all keys. The white key 11*w* and the black key 11*b* are supported by a key support portion 13*w* and a key support portion 13*b* of a later-described key frame 12 with the through-holes Kw and Kb.

The back end of the white key 11*w* goes into a casing of the electronic musical instrument, when the keyboard device is assembled to the electronic musical instrument. The portion of the white key anterior to the portion going into the casing is referred to as an apparent portion of the white key 11*w*. An edge line is formed on the portion where the side face and the top face of the white key 11*w* cross each other. The black key 11*b* has a portion projecting upward from the top face of the white key 11*w* in a state in which the black key 11*b* is not depressed, and the adjacent white keys 11*w* are not depressed. The projecting portion is referred to as an apparent portion of the black key 11*b*. The portion lower than the apparent portion of the black key 11*b* is referred to as a body. A performer depresses or releases the apparent portions of the white key 11*w* and the black key 11*b*. Specifically, the apparent portion corresponds to an operation portion in the present invention. The width of the apparent portion of the black key 11*b* in the lateral direction becomes narrower toward the top end, and the width of the body in the lateral direction is the same for all black keys. An edge line is formed on the boundary between the lower end of the apparent portion of the black key 11*b* and the portion lower than the lower end of the apparent portion.

The key frame 12 has a top plate 12*a* extending in the longitudinal direction and lateral direction. The position of the front end of the top plate 12*a* at the low-pitched side and the position of the front end at the high-pitched side are the same, but the back end at the low-pitched side is located posterior to the back end at the high-pitched side. The key frame 12 also has a front plate 12*b* vertically extending downward from the front end of the top plate 12*a*, a bottom plate 12*c* horizontally extending from the lower end of the front plate 12*b*, and a front plate 12*d* vertically extending upward from the front end of the bottom plate 12*c*. The key frame 12 also includes a rear plate 12*e* vertically extending downward from the back end of the top plate 12*a*, and a bottom plate 12*f* horizontally extending rearward from the lower end of the rear plate 12*e*. The height of the lower surface of the bottom plate 12*c* and the height of the lower surface of the bottom plate 12*f* are the same. The keyboard device is supported by a frame FR of an electronic musical instrument by the structure in which the lower surface of the bottom plate 12*c* and the lower surface of the bottom plate 12*f* are brought into contact with the frame FR of the electronic musical instrument and fixed thereto. The above-described key support portion 13*w* and the key support portion 13*b* are formed to project upward from the upper surface of the top plate 12*a*. The key support portion 13*b* is located posterior to the adjacent key support portion 13*w*. The key support portion 13*w* and the key support portion 13*b* respectively include two opposing plates, and a projection 13*w*1 and projection 13*b*1 that project inward. The projections 13*w*1 and 13*b*1 are fitted to the through-holes Kw and Kb respectively. Therefore, the white key 11*w* and the black key 11*b* are supported to be rotatable about the projections 13*w*1 and 13*b*1, and their front ends can rock in the vertical direction with the through-holes Kw and Kb and the center axes of the projections 13*w*1 and the projections 13*b*1 being defined as a pivot center. The distance between the top face of the apparent portion of the white key 11*w* (i.e., the plane including the right and left edge lines of the white key 11*w*) and its pivot center in the vertical direction is the same for all white keys 11*w*. The distance between the top face of the operation portion of the black key 11*b* (i.e., the plane including the right and left edge lines of the black key 11*b*) and its pivot center in the vertical direction is the same for all black keys 11*b*.

A drive unit 11*w*1 extends downward from the front end of the apparent portion of the white key 11*w*. The drive unit 11*w*1 has a hollow shape including a thin front wall extending in the vertical direction, and thin sidewalls extending rearward from left and right ends of the front wall, and is open to the rear. The lower end of the drive unit 11*w*1 is closed by a lower end wall. The length of the drive unit 11*w*1 in the vertical direction is the same for all white keys 11*w*. On the other hand, the black key 11*w* also has a drive unit 11*b*1 same as the drive unit 11*w*1 of the white key 11*w*. The length of the drive unit 11*b*1 in the vertical direction is also the same for all black keys 11*b*.

The positions of the drive units 11*w*1 of the plural white keys 11*w* in the longitudinal direction are the same, and the positions of the lower end walls of the drive units 11*w*1 in the vertical direction are the same, when the plural white keys 11*w* are released. The positions of the drive units 11*b*1 of the plural black keys 11*b* in the longitudinal direction are the same, and the positions of the lower end walls of the drive units 11*b*1 in the vertical direction are the same, when the plural black keys 11*b* are released. In other words, the drive units 11*w*1 and the drive units 11*b*1 are arranged side by side in the lateral direction.

Figure 4:
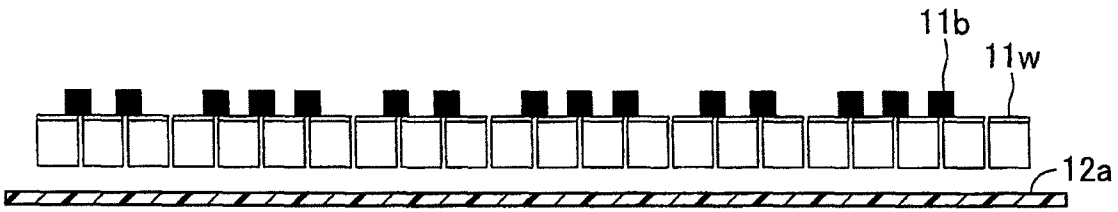
FIG. 4 is a front view for describing a height of a front end of the key.
Figure 5:
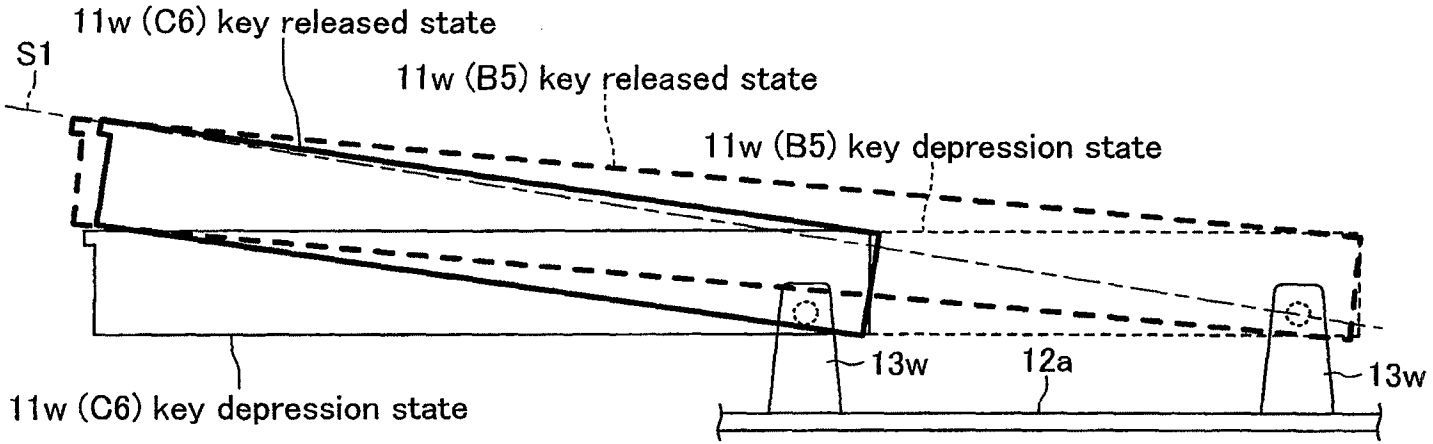
FIG. 5 is a side view for describing a tilt angle of a top face of the white key.

Since the length of the drive unit 11*w*1 in the vertical direction is the same for all white keys 11*w*, and the positions of the lower ends of the drive units 11*w*1 in the vertical direction and in the longitudinal direction are the same during the key release, the position of the front end of the apparent portion in the vertical direction is almost the same as illustrated in FIG. 4. As illustrated in FIG. 5, the white key 11*w* tilts such that the back end is lower than the front end during the key release, and the front end of the white key 11*w* having the shorter length in the longitudinal direction is located posteriorly. In the present embodiment, the length in the longitudinal direction becomes gradually shorter from the white key 11*w* on the low-pitched side toward the white key 11*w* on the high-pitched side. Therefore, the front end of the apparent portion of the white key 11*w* on the high-pitched side is located posteriorly. In a state in which two adjacent white keys 11*w* and the black key 11*b* between the two adjacent white keys 11*w* are released, the edge line R of the black key 11*b* is located below the top face of one on the low-pitched side of the two white keys 11*w*, and above the top face of one on the high-pitched side of the two white keys 11*w*.

In a state in which the white key 11*w* (C6) to which a pitch "C6" is assigned and the white key 11*w* (B5) to which a pitch "B5" is assigned are released, for example, the front end of the white key 11*w* (C6) is located slightly posterior to the front end of the white key 11*w* (B5) (see FIG. 5). The pivot center of the white key 11*w* (C6) is located below a plane S1 including the pivot center of the white key 11*w* (B5) and the front end of the apparent portion of the white key 11*w* (B5). FIG. 5 illustrates the posture when the white key 11*w* (B5) and the white key 11*w* (C6) are released and depressed. Specifically, the white key 11*w* (B5) that is released is indicated by a bold broken line, and the white key 11*w* (B5) that is depressed is indicated by a thin broken line. The white key 11*w* (C6) that is released is indicated by a bold solid line, and the white key 11*w* (C6) that is depressed is indicated by a thin solid line. In FIG. 5, the length of the white key 11*w* (C6) and the length of the white key 11*w* (B5) are greatly different in order to indicate the difference between the positions of the front ends of the apparent portions of the white keys 11*w* in the longitudinal direction, each having a different length in the longitudinal direction. However, the difference between the lengths of the adjacent keys is actually small, so that the difference in height between the white keys 11*w* is also small. In FIG. 5, the shape of each key is simplified in order to simplify the drawing.

As described above, the tilt angle of the white key 11$w$ having the shorter length in the longitudinal direction is larger in the key release state. The positional relationship between the plane including the pivot center and the front end of the apparent portion and the top face for each white key 11$w$ is set such that the top faces of the plural white keys 11$w$ are horizontal when the plural white keys 11$w$ are depressed, and their rocking angles from the key release state reach the same predetermined rocking angle (i.e., when the hammer 13$w$ is brought into contact with a buffer member 20$b$ to restrict the rocking movement of the white key 11$w$ as described later). In other words, the angle of the top face with respect to the plane including the pivot center and the front end of the apparent portion is set for each of the white keys 11$w$. The position of the front end of the apparent portion of the white key 11$w$ in the vertical direction and in the longitudinal direction is the same for all white keys 11$w$ in the state in which the top face of each of the plural white keys 11$w$ is horizontal.

Figure 6:
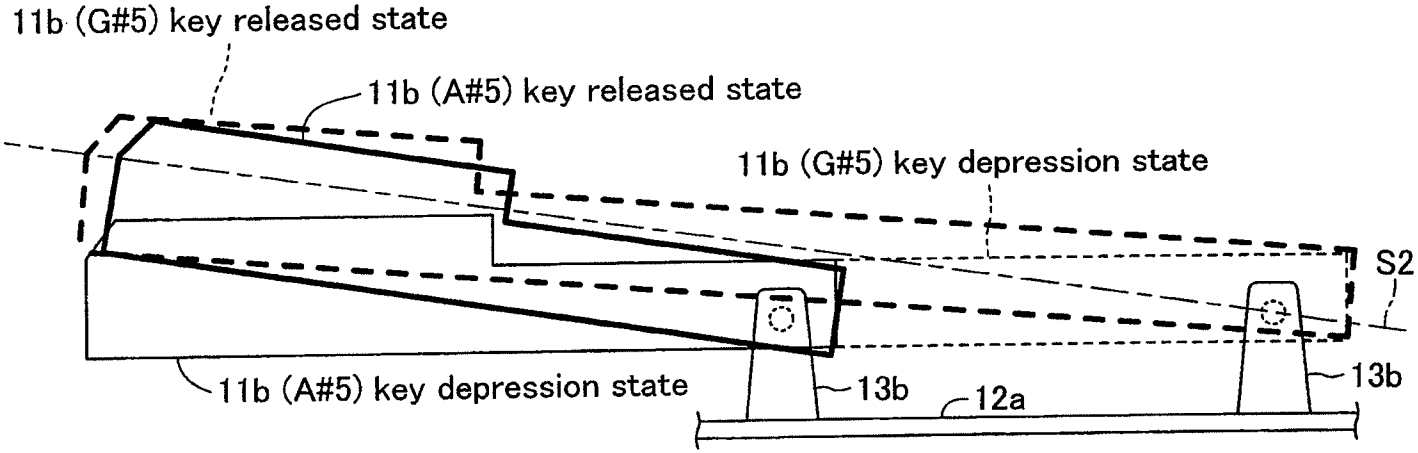
FIG. 6 is a side view for describing a tilt angle of a top face of the black key.

Since the length of the drive unit 11$b$1 in the vertical direction is the same for all black keys 11$b$, and the positions of the lower ends of the drive units 11$b$1 in the vertical direction and in the longitudinal direction are the same during the key release as described above, the position of the front end of the apparent portion in the vertical direction is almost the same, when the black key 11$b$ is released. The black key 11$b$ tilts such that the back end is lower than the front end during the key release, and the key having the shorter length in the longitudinal direction has the larger tilt angle. The front end of the black key 11$b$ having the shorter length in the longitudinal direction is located posteriorly. In the present embodiment, the length in the longitudinal direction becomes gradually shorter from the black key 11$b$ on the low-pitched side toward the black key 11$b$ on the high-pitched side. Therefore, the front end of the apparent portion of the black key 11$b$ on the high-pitched side is located posteriorly. For example, in a state in which the black key 11$b$ (G#5) to which a pitch "G#5" is assigned and the black key 11$b$ (A#5) to which a pitch "A#5" is assigned are released, the front end of the black key 11$b$ (A#5) is slightly posterior to the front end of the apparent portion of the black key 11$b$ (G#5) as illustrated in FIG. 6. The pivot center of the black key 11$b$ (A#5) is located below a plane S2 including the pivot center of the black key 11$b$ (G#5) and the front end of the apparent portion of the black key 11$b$ (G#5). FIG. 6 illustrates the posture when the black key 11$b$ (G#5) and the black key 11$b$ (A#5) are released and depressed. Specifically, the black key 11$b$ (G#5) that is released is indicated by a bold broken line, and the black key 11$b$ (G#5) that is depressed is indicated by a thin broken line. The black key 11$b$ (A#5) that is released is indicated by a bold solid line, and the black key 11$b$ (A#5) that is depressed is indicated by a thin solid line. In FIG. 6, the length of the black key 11$b$ (G#5) and the length of the black key 11$b$ (A#5) are greatly different in order to indicate the difference between the height of the front ends of the apparent portions of the black keys 11$b$, each having a different length in the longitudinal direction. However, the difference between the lengths of the adjacent keys is actually small, so that the difference in height between the black keys 11$b$ is also small. In FIG. 6, the shape of each key is simplified in order to simplify the drawing.

The positional relationship between the plane including the pivot center and the front end of the apparent portion and the top face for each black key 11$b$ is set such that the top faces of the plural black keys 11$b$ are horizontal when the plural black keys 11$b$ are depressed, and their rocking angles from the key release state reach the same predetermined rocking angle (i.e., when the hammer 13$b$ is brought into contact with a buffer member 21$b$ to restrict the rocking movement of the black key 11$b$ as described later). In other words, the angle of the top face with respect to the plane including the pivot center and the front end of the apparent portion is set for each of the black keys 11$b$. The position of the front end of the apparent portion of the black key 11$b$ in the vertical direction and in the longitudinal direction is the same for all black keys 11$b$ in the state in which the top face of each of the plural black keys 11$b$ is horizontal.

The lower ends of the drive unit 11$w$1 and the drive unit 11$b$1 are respectively engaged with front ends of hammers 16$w$ and 16$b$ in the opening formed between the front plate 12$b$ and the front plate 12$d$. In the key released state, contact portions Pw1 and Pb1 between the lower ends of the drive unit 11$w$1 and the drive unit 11$b$1 and the front ends of the hammers 16$w$ and 16$b$ are located on the same straight line extending respectively in the lateral direction (the direction parallel to the key arrangement direction).

The hammer 16$w$ includes a base 16$w$1 made of synthetic resin, a connection rod 16$w$2 made of metal, and a mass member 16$w$3. Like the hammer 16$w$, the hammer 16$b$ includes a base 16$b$1, a connection rod 16$b$2, and a mass member 16$b$3. The base 16$w$1 and the base 16$b$1 are plate-like members, and formed with through-holes Hw and Hb, respectively, from the right side face to the left side face. The base 16$w$1 is longer than the base 16$b$1 in the longitudinal direction. A hammer support portion 18$w$ and a hammer support portion 18$b$ are formed to project downward from the lower surface of the top plate 12$a$. The hammer support portions 18$w$ and 18$b$ are formed to have two opposing plates, and respectively have projections 18$w$1 and 18$b$1 projecting inward. The projections 18$w$1 and 18$b$1 are respectively fitted to the through-holes Hw and Hb. With this structure, the bases 16$w$1 and 16$b$1 are supported to be rotatable about the projections 18$w$1 and 18$b$1. Specifically, the hammer 16$w$ and the hammer 16$b$ are supported such that the front ends and the back ends can be rocked in the vertical direction. The positions of the hammer support portion 18$w$ and the hammer support portion 18$b$ in the longitudinal direction and in the vertical direction are the same for all hammers. Specifically, plural hammer support portions 18$w$ and 18$b$ are arranged side by side in the lateral direction, wherein the positions of the pivot center of the hammers 16$w$ and 16$b$ in the longitudinal direction and in the vertical direction are the same for all hammers 16$w$ and 16$b$. In other words, the pivot centers of the hammers 16$w$ and 16$b$ are located on the same straight line extending in the lateral direction.

The base 16$w$1 includes a pair of leg portion Fw1 and leg portion Fw2 on its front end. The upper leg portion Fw1 is formed to be shorter than the lower leg portion Fw2. Like the base 16$w$1, the base 16$b$1 includes a pair of leg portion Fb1 and leg portion Fb2 on its front end. An elongated slit-like opening 12$b$1 extending in the vertical direction is formed on the front plate 12$b$ for each of the hammers 16$w$ and 16$b$. The front end of each hammer 16$w$ and the front end of each hammer 16$b$ project forward of the front plate 12$b$ through the opening 12$b$1. The wall of the lower end of the drive unit 11$w$1 enters between the leg portions Fw1 and Fw2, while the wall of the lower end of the drive portion 11$b$1 enters between the leg portions Fb1 and Fb2. The leg portions Fw1 and Fb1 enter between the walls of the lower ends of the drive units 11$w$1 and 11$b$1 and intermediate walls that form gaps with the walls of the lower ends in the drive units 11$w$1 and 11$b$1. A shock absorbing material such as rubber, urethane, or felt is fitted and fixed on the wall of the lower end of each of the drive units 11$w$1 and 11$b$1. The shock absorbing material absorbs shock caused by the collision between the lower end of the drive unit 11$w$1 and the upper surface of the leg portion Fw2, the collision between the lower end of the drive unit 11$b$1 and the upper surface of the leg portion Fb2, the collision between the lower end of the drive unit 11$w$1 and the lower surface of the leg portion Fw1, and the collision between the lower end of the drive unit 11$b$1 and the lower surface of the leg portion Fb1.

The front end of the connection rod 16$w$2 and the front end of the connection rod 16$b$2 are assembled to the back end of the base 16$w$1 and the back end of the base 16$b$1, respectively. The connection rods 16$w$2 and 16$b$2 extend rearward. The position of the back end of the connection rod 16$w$2 and the position of the back end of the connection rod 16$b$2 in the longitudinal direction are the same. The mass member 16$w$3 and the mass member 16$b$3, described later, are assembled to the back end of the connection rod 16$w$2 and the back end of the connection rod 16$b$2, respectively. The distance from the leading ends to the hammer support portions (the pivot centers) of the hammers 16$w$ and 16$b$ is the same for all hammers 16$w$ and 16$b$.

As described above, the position of the pivot point of the key is different depending upon the assigned pitch. Therefore, the distance from the pivot center of the white key 11$w$ to the contact portion Pw1 of the leg portion Fw2 and the drive unit 11$w$1 is different depending upon the assigned pitch. The distance from the pivot center of the black key 11$b$ to the contact portion Pb1 of the leg portion Fb2 and the drive unit 11$b$1 is also different depending upon the assigned pitch. Therefore, if the masses of the mass members for all hammers are equal, a key touch feeling is heavier on the middle-pitched part than on the low-pitched part, and the key touch feeling is heavier on the high-pitched part than on the middle-pitched part, on key depression/release operation positions W0 and B0, because of the principle of leverage.

Figure 7:
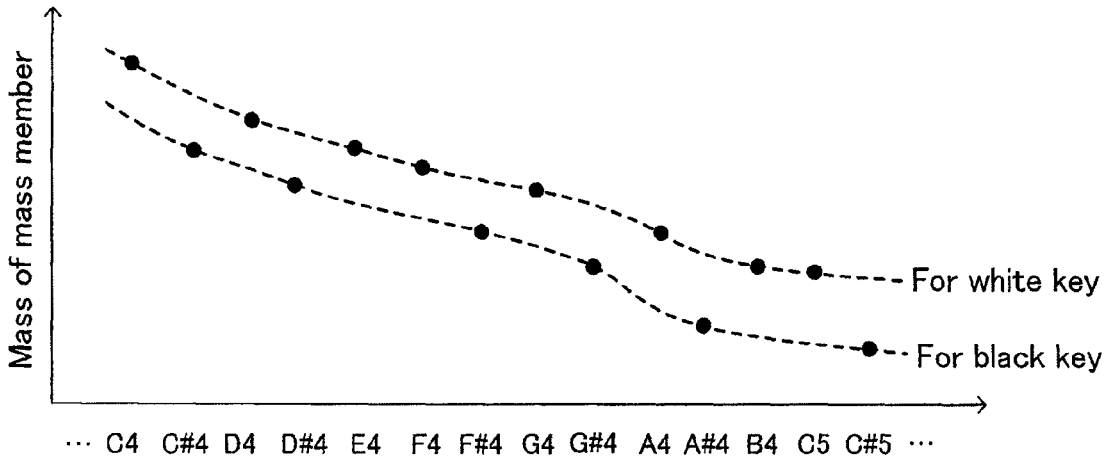
FIG. 7 is a graph of a characteristic curve illustrating a relationship between a pitch and a mass of a mass member.
Figure 8:
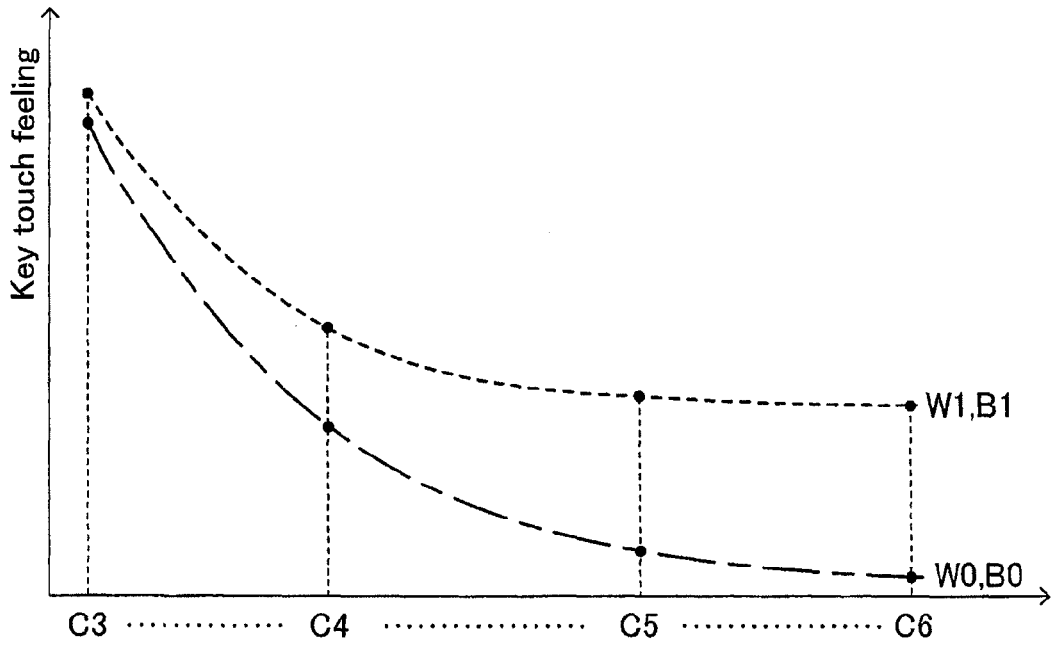
FIG. 8 is a graph of a characteristic curve illustrating a relationship between a pitch and a key touch.

In addition, in this case, the key touch feeling of the white keys 11$w$ and the black keys 11$b$ in each range is not equal. Specifically, the key touch feeling of the key 11$b$ is heavier than the key touch feeling of the adjacent two white keys 11$w$. In view of this, the mass of the mass member 16$w$3 and the mass of the mass member 16$b$3 are adjusted for each key as illustrated in FIG. 7. Specifically, as illustrated in a characteristic curve indicating the masses of the mass members 16$w$3 and 16$b$3 in the order of pitches, the masses of the mass members 16$w$3 and 16$b$3 are adjusted such that the characteristic curve of the mass member 16$w$3 and the characteristic curve of the mass member 16$b$3 are parallel downward-sloping curves, wherein the characteristic curve of the mass member 16$b$3 is located below the characteristic curve of the mass member 16$w$3. In other words, the mass member 16$w$3 for the white key 11$w$ is heavier than the mass member 16$b$3 for the neighboring black key 11$b$. Thus, as illustrated by a chain line in FIG. 8, the key touch feeling on the key depression/release operation positions W0 and B0 becomes gradually lighter toward the high-pitched side from the low-pitched side. Therefore, as illustrated by a broken line in FIG. 8, the key touch feeling on key depression/release operation positions W1 and B1 located posterior to the key depression/release operation positions W0 and B0 by a distance d also becomes gradually lighter toward the high-pitched side from the low-pitched side. Since the length of the key to which a higher pitch is assigned is shorter, the difference between the key touch feeling on the key depression/release operation positions W0 and B0 and the key touch feeling on the key depression/release operation positions W1 and B1 becomes larger toward the high-pitched side from the low-pitched side. Specifically, the difference in the key touch feeling caused by the longitudinal difference of the key depression/release operation position is small on the low-pitched side, moderate in the middle-pitched side, and large on the high-pitched side.

When the white key 11$w$ and the black key 11$b$ are released, the front ends of the hammers 16$w$ and 16$b$ displace upward due to their own weight of the hammers 16$w$ and 16$b$. In this case, the drive unit 11$w$1 and the drive unit 11$b$1 are biased upward by the leg portion Fw2 and the leg portion Fb2 respectively, whereby the front ends of the white key 11$w$ and the black key 11$b$ displace upward. On the other hand, when the white key 11$w$ and the black key 11$b$ are depressed, the lower surfaces of the drive unit 11$w$1 and the drive unit 11$b$1 press the upper surfaces of the leg portion Fw2 and the leg portion Fb2 respectively, whereby the front ends of the hammer 16$w$ and the hammer 16$b$ respectively displace downward.

A lower-limit stopper 20 is provided to the key frame 12. During the key depression, the lower-limit stopper 20 is brought into contact with the upper surfaces of the mass member 16$w$3 and the mass member 16$b$3 of the hammer 16$w$ and the hammer 16$b$ so as to restrict the upward displacement of the back ends of the hammer 16$w$ and the hammer 16$b$, thereby restricting the downward displacement of the front ends of the white key 11$w$ and the black key 11$b$. The lower-limit stopper 20 includes a stopper rail 20$a$ and a buffer material 20$b$. The stopper rail 20$a$ protrudes downward from the lower surface at the middle of the top plate 12$a$, and extends in the lateral direction. The stopper rail 20$a$ is located above the mass member 16$w$3 and the mass member 16$b$3. The projection amount of the stopper rail 20$a$ from the lower surface of the top plate 12$a$ on the contact portion between the stopper rail 20$a$ and each hammer is constant in the lateral direction. The buffer material 20$b$ is fixed to the lower end surface of the stopper rail 20$a$. The buffer material 20$b$ is a long member made of a shock-absorbing material such as rubber or felt. The sectional shape of the buffer material 20$b$ is uniform from one end to the other end.

An upper-limit stopper 21 is provided to the middle portion of the frame FR. During the key release, the upper-limit stopper 21 is brought into contact with the lower surfaces of the mass member 16$w$1 and the mass member 16$b$1 of the hammer 16$w$ and the hammer 16$b$ so as to restrict the downward displacement of the back ends of the hammer 16$w$ and the hammer 16$b$, thereby restricting the upward displacement of the front ends of the white key 11$w$ and the black key 11$b$. Like the lower-limit stopper 20, the upper-limit stopper 21 includes a stopper rail 21$a$ and a buffer material 21$b$. Specifically, the stopper rail 21$a$ also extends in the lateral direction, and the projection amount thereof from the frame FR is constant in the lateral direction. The buffer material 21$b$ is fixed on the upper surface of the stopper rail 21$a$. Like the buffer material 20$b$, the sectional shape of the buffer material 21$b$ is uniform from one end to the other end. The stopper rail 20$a$ and the stopper rail 21$a$ may continuously extend in the lateral direction, or may discontinuously extend. The stopper rail 20$a$ and the stopper rail 21$a$ may be formed integral with the top plate 12$a$ and the frame FR respectively, or may be formed as separate components and assembled to the top plate 12$a$ and the frame FR respectively.

In the state in which the white key 11$w$ and the black key 11$b$ adjacent to the white key 11$w$ are depressed respectively by the same depression force, and their rocking movement is restricted, the edge line R of the black key 11$b$ is located below the top face of the white key 11$w$. The buffer member 20$b$ and the buffer member 21$b$ have elasticity. Therefore, when the key is depressed more after the hammer is brought into the buffer member during the key depression, the buffer member is elastically deformed, so that the front end of the key slightly displaces downward.

A switch drive unit AC1 is provided on the lower surface of each of the white key 11*w* and the black key 11*b* on the middle part. The switch drive unit AC1 is a plate-like member extending in the vertical direction in each of the white key 11*w* and the black key 11*b*, and the lower end surface of the switch drive unit AC1 is brought into contact with the upper surface of a switch SW1. The switch SW1 is provided for each key. The switch SW1 is pressed by the corresponding key to detect whether the corresponding key is depressed or released. Specifically, when the switch SW1 is depressed by the key, a rubber main body is deformed to make two contacts, which are formed on a circuit board 23, short-circuit, thereby being turned ON. The circuit board 23 extends in the lateral direction. A through-hole penetrating from the upper surface to the lower surface is formed on the circuit board 23. The through-hole corresponds to a boss 24 formed integral with the upper surface of the top plate 12*a*. When a screw is threaded to the boss 24 through the through-hole, the circuit board 23 is fixed to the key frame 12. The main bodies of the plural switches SW1, each corresponding to each key, are arranged on the upper surface of the circuit board 23 in the lateral direction. The position of the switch SW1 for the white key 11*w* and the position of the switch SW1 for the black key 11*b* in the longitudinal direction are the same. A distance Lw1 from the front end of the white key 11*w* to the switch SW1 in the longitudinal direction is within 30% of the distance Lw2 from the front end of the white key 11*w* with the highest pitch to the through-hole Kw, and a distance Lb1 from the front end of the apparent portion of the black key 11*b* to the switch SW1 is within 30% of the distance Lb2 from the front end of the apparent portion of the black key 11*b* with the highest pitch to the through-hole Kb. The switch SW1 for the white key 11*w* and the switch SW1 for the black key 11*b* may be arranged side by side in the lateral direction, and the positions of both switches in the longitudinal direction may be shifted.

Key guides 25*w* and 25*b* for guiding the rocking movement of the white key 11*w* and the black key 11*b* are formed to project upward from the top surface at the front end of the top plate 12*a*. The key guide 25*w* is inserted into the white key 11*w* from below, and during the key depression and key release, the side face of the key guide 25*w* and the inside face of the sidewall of the white key 11*w* are in sliding contact with each other. This structure can prevent a slight displacement of the white key 11*w* in the lateral direction during the key depression and key release. The key guide 25*b* is inserted into the black key 11*b* from below, and during the key depression and key release, the side face of the key guide 25*b* and the inside face of the sidewall of the black key 11*b* are in sliding contact with each other. This structure can prevent a slight displacement of the black key 11*b* in the lateral direction during the key depression and key release.

In the keyboard device having the configuration described above, the appearance can be made close to the appearance of a keyboard on an acoustic piano without a need to adjust the height of the front end of the key for each key in the key released state and the key depression state. When the plural white keys 11*w* and the black keys 11*b* have the maximum depth during the key depression, the top faces of the white keys 11*w* and the black keys 11*b* are horizontal. Therefore, the appearance similar to the appearance of the acoustic piano in the key depression state can be created. Accordingly, the number of components can be reduced, compared to the case where the height of the front end of the key is adjusted for each key, whereby the cost for the keyboard device can be reduced. The front end of the white key 11*w* is gradually located posteriorly from the white key 11*w* on the low-pitched side toward the white key 11*w* on the high-pitched side during the key release, and the front end of the black key 11*b* is gradually located posteriorly from the black key 11*b* on the low-pitched side toward the black key 11*b* on the high-pitched side during the key release. Specifically, the difference in the positions of the front end between the adjacent white keys 11*w* and between the adjacent black keys 11*b* in the longitudinal direction is small in the key released state. Accordingly, the present embodiment can create comfortable appearance in the key released state.

The distance from the top face of the apparent portion of the white key 11*w* to the pivot center is the same for all white keys 11*w*, and the distance from the top face of the body of the black key 11*b* to the pivot center is the same for all black keys 11*b*. Accordingly, when the through-holes Kw and Kb are formed in a different process after a process of molding the outer shape of the white key 11*w* and the black key 11*b*, the different process can commonly be carried out for all keys to enhance productivity of the keys.

All components of the hammer 16*w*, except for the mass member 16*w*3, are the same for all hammers 16*w*. In addition, all components of the hammer 16*b*, except for the mass member 16*b*3, are the same for all hammers 16*b*. Accordingly, the variety of the components can be reduced, so that the cost for the keyboard device can be reduced. The positions of the pivot centers of the hammers in the longitudinal direction and in the vertical direction are the same for all hammers, and the positions of the upper-limit stopper 21 and the lower-limit stopper 20 in the longitudinal direction and in the vertical direction are the same for all hammers. Therefore, the upper-limit stopper 21 and the lower-limit stopper 20 can easily be assembled. The number of components can be reduced, compared to the case in which the stopper is provided for each hammer, resulting in that the cost for the keyboard device can be reduced. As described above, the positions of the pivot centers of the hammers and the positions of the upper-limit stopper 21 and the lower-limit stopper 20 in the longitudinal direction and in the vertical direction are the same for all hammers. Therefore, the ranges of the rocking angle of the hammers can be the same for all hammers.

In the present embodiment, when the white key 11*w* is assembled to the key frame 12, the wall of the lower end of the drive unit 11*w*1 has to be inserted between the leg portion Fw1 and the leg portion Fw2. When the black key 11*b* is assembled to the key frame 12, the wall of the lower end of the drive unit 11*b*1 has to be inserted between the leg portion Fb1 and the leg portion Fb2. In the present embodiment, the positions of the contact portions Pw1 in the longitudinal direction and in the vertical direction during the key release are the same for all white keys 11*w* and all hammers 16*w*. With this structure, the walls of the lower ends of the drive units 11*w*1 for the plural white keys 11*w* are easy to be simultaneously inserted between the leg portions. The positions of the contact portions Pb1 in the longitudinal direction and in the vertical direction during the key release are the same for all black keys 11*b* and all hammers 16*b*. With this structure, the walls of the lower ends of the drive units 11*b*1 for plural black keys 11*b* are easy to be simultaneously inserted between the leg portions. Specifically, plural white keys 11*w* and black keys 11*b* can be assembled at a time, whereby an assembling property for assembling the keys to the key frame 12 can be enhanced.

Since the ranges of the rocking angles of the hammers are the same for all hammers, the rocking range of the front end of the apparent portion of the white key 11*w* is the same for all white keys 11*w*. The rocking range of the front end of the apparent portion of the black key 11*b* is also the same for all black keys 11*b*. In the present embodiment, the distances Lw1 and Lb1 are set to be sufficiently smaller than the distances Lw2 and Lb2 respectively. Therefore, a performer is easy to play the keyboard device.

Plural switches SW1, each corresponding to each key, are arranged side by side in the lateral direction. The maximum depth of the front end of each key during the key depression is almost the same for all white keys 11*w* as described above. Therefore, if the switches SW1 are arranged side by side in the lateral direction near the front end of the white key 11*w*, the depth of the key during the key depression when the ON/OFF state of each switch SW1 is changed is almost the same. Therefore, this can realize that the switches SW1 for all white keys 11*w* have the same characteristics. Like the switches SW1 for the white keys 11*w*, the characteristics of the switches SW1 for all black keys 11*b* can be the same. Specifically, not only the variety of the components can be reduced to reduce the cost for the keyboard device, but also the key depression/release state of each white key 11*w* and each black key 11*b* can be detected respectively by the same process in the electronic musical instrument to which this keyboard device is applied. The circuit board 23 including the contacts of the plural switches SW1 is provided to extend in the lateral direction. Therefore, the assembling property for the assembling operation can be enhanced, compared to the case in which the switch SW1 is assembled for each key.

Upon embodying the present invention, the present invention is not limited to the above-described embodiment, and various modifications are possible without departing from the scope of the present invention.

For example, instead of the switch SW1, or in addition to the switch SW1, an optical sensor, a magnetic sensor, a capacitance sensor, or a pressure-sensitive sensor may be used to detect whether the key is depressed or released.

In the present embodiment, the pivot centers of the hammers 16*w* and the hammers 16*b* are formed on the middle part of the respective hammers 16*w* and 16*b*, for example. The engagement portions between the white key 11*w* and the hammer 16*w* as well as between the black key 11*b* and the hammer 16*b* are formed on the front end of the hammer 16*w* and the front end of the hammer 16*b*, respectively. However, the pivot center of each hammer and the position of the engagement portion are not limited to those described in the above embodiment. For example, the pivot centers may be formed on the back end of the hammer 16*w* and the back end of the hammer 16*b*. The engagement portions may be formed on the middle part of the hammer 16*w* and on the middle part of the hammer 16*b*, and the mass member 16*w*3 and the mass member 16*b*3 may be mounted on the front end of the hammer 16*w* and the front end of the hammer 16*b* respectively. In this case, the front ends of the hammer 16*w* and the hammer 16*b* are biased upward by an elastic member such as a spring or rubber during the key release. In this case too, the pivot centers of the respective hammers and the engagement portions may be arranged side by side in the lateral direction, and the stopper for restricting the rocking movement of the hammers 16*w* and 16*b* may be arranged in the lateral direction. With the configuration in which the front ends of the hammers 16*w* and 16*b* rock in the vertical direction about the back ends of the hammers 16*w* and 16*b* as described above, the effect same as that of the above-mentioned embodiment can also be obtained.

For example, in the present embodiment, the mass member 16*w*3 and the mass member 16*b*3 are mounted to the back ends of the connection rod 16*w*2 and the connection rod 16*b*2. However, the mass member 16*w*3 and the mass member 16*b*3 are not mounted, but the leading ends of the connection rod 16*w*2 and the connection rod 16*b*2 may be folded back to the front so as to concentrate the mass on the back ends of the hammer 16*w* and the hammer 16*b*. By adjusting the length of the folded portion, the mass at the back ends of the hammer 16*w* and the hammer 16*b* may be adjusted.

In the embodiment described above and its modifications, the masses of the mass member 16*w*3 and the mass member 16*b*3 are adjusted to make the key touch feeling on the front end of the key gradually light toward the keys on the high-pitched side from the keys on the low-pitched side. However, the present invention is not necessarily configured as described above. The key touch feeling on the front end of the key in each range may be set to be the same, and the key touch feeling may be made light in a stepwise manner for each range toward the high-pitched range. It may also be configured such that the key touch feeling may become light in the order of pitches in only a certain range. Alternatively, it may be configured such that the key touch feeling may be set to be the same for all keys.

In the embodiment described above and its modifications, the length of the white key 11*w* becomes gradually shorter toward the white keys 11*w* on the high-pitched side from the white keys 11*w* on the low-pitched side, while the length of the black key 11*b* becomes gradually shorter toward the black keys 11*b* on the high-pitched side from the black keys 11*b* on the low-pitched side. However, the present invention is not necessarily configured as described above. The positions of the pivot centers of plural keys may be shifted in the longitudinal direction, and the positions of the respective portions for these keys may be set to be the same. For example, the whole range is divided into plural ranges, and the length of each of the keys belonging to each of the divided ranges may be set to be the same (i.e., the positions of the pivot centers of the keys in the longitudinal direction and in the vertical direction are set to be the same), while the length of the keys may be set to be different among the divided ranges. The positions of the respective portions in each of the divided plural ranges may be set to be the same. According to this configuration, the effect same as the above-mentioned embodiment can be obtained.

In the embodiment and its modification described above, the distance from the top face of the apparent portion of the white key 11*w* to its pivot center is the same for all white keys 11*w*. The distance from the top face of the body of the black key 11*b* to its pivot center is the same for all black keys 11*b*. The height of the pivot center is the same for all keys. However, the distance from the top face of the apparent portion of the white key 11*w* to its pivot center, the distance from the top face of the body of the black key 11*b* to its pivot center, and the height of the pivot center may be different for each key. Specifically, the distance from the top face of the apparent portion of the white key 11*w* to its pivot center, and the height of the pivot center may be set such that the top faces of the apparent portions of the plural white keys 11*w* are located on the same plane on any rocking position within the rocking range of the plural white keys 11*w*. The distance from the top face of the apparent portion of the black key 11*b* to its pivot center, and the height of the pivot center may be set such that the top faces of the apparent portions of the plural black keys 11*b* are located on the same plane on any rocking position within the rocking range of the plural black keys 11*b*.

The top faces of the white keys 11*w* during the key release may be located on the same plane, although this structure creates an appearance slightly different from the appearance of an acoustic piano. The top faces of the black keys 11*b* during the key release may be located on the same plane. In this case, when two keys having different length are compared, the pivot center of the shorter key may be located in the planes S1 and S3 (see FIGS. 5 and 6) of the longer key.

In the embodiment described above and its modifications, the distance from the leading end to the hammer support potion of each of the hammers 16*w* and 16*b* in the longitudinal direction is set to be the same. However, the distance from the leading end to the hammer support potion of each of the hammers 16*w* and 16*b* may be set to be gradually shorter toward the high-pitched side from the low-pitched side. In this case, the rate of change of the distance from the leading end to the hammer support potion of each of the hammers 16*w* and 16*b* from the low-pitched side toward the high-pitched side may be set constant, and the lower-limit stopper 20 and the upper-limit stopper 21 on the high-pitched side may be arranged anterior to the lower-limit stopper 20 and the upper-limit stopper 21 on the low-pitched side. Specifically, the lower-limit stopper 20 and the upper-limit stopper 21 may be arranged diagonally, as viewed on a plane, in order that the ranges of the rocking angle of the hammers are the same for all hammers. With this structure, the number of components can be reduced, and the cost for the keyboard device can be reduced, compared to the case in which the stopper is provided for each hammer.

In the embodiment described above and its modifications, the white key 11*w* and the black key 11*b* are supported by the key support portions 13*w* and 13*b* of the key frame 12 by fitting the projections 13*w*1 and 13*b*1 to the through-holes Kw and Kb respectively so that the front ends of the white key 11*w* and the black key 11*b* can rock in the vertical direction. However, the white key 11*w* and the black key 11*b* can be mounted on the key frame 12 by using various supporting mechanisms, if the white key 11*w* and the black key 11*b* are supported by the key frame 12 so that the front ends of the white key 11*w* and the black key 11*b* can rock in vertical direction. For example, the rear ends of plural keys (the white key 11*w* and/or the black key 11*b*) may be are supported by the key frame 12 through elastic deformation members so that the front ends of the plural keys can rock in vertical direction. Concretely, the rear ends of the plural keys are connected to a fixing member fixed to the key frame 12 through thin and elastic connection members, wherein the fixing member is extended in the lateral direction, the connection members are extended horizontally or vertically, and the plural keys, the connection members and the fixing member are formed integrally. In this case, for example, the connection members for the white keys 11*w* are extended horizontally, and the connection members for the black keys 11*b* are extended vertically.

What is claimed is:

1. A keyboard device for an electronic musical instrument, the keyboard device comprising:

plural white keys and black keys that are supported by a key support portion in order that front ends thereof rock in the vertical direction by a key depression/release operation by a performer, each white key having an edge line extending in the longitudinal direction on a crossing portion of a side face and a top face, and each black key having an edge line extending in the longitudinal direction on a crossing portion of a lower side face and an upper side face tilting inward with respect to the lower side face, wherein a pitch is assigned to each of the plural white keys and black keys, each of plural white keys and each of black keys include an operation portion that is depressed and released by the performer, and a drive unit extending downward on a front end of the operation portion, and a length from the front end of the operation portion to the key support portion is different among the plural white keys and black keys;

plural hammers, each of which includes an engagement portion engaged with the drive unit of each of the plural white keys and the drive unit of each of the plural black keys, and each of which is supported by a hammer support portion in order to rock with the rocking movement of each of the plural white keys and black keys; and a restricting member that is arranged to extend in the direction of the arrangement of the plural white keys and black keys, and that restricts the rocking movement of the plural hammers in order to restrict the rocking range of the plural white keys and the plural black keys, wherein, when a first key out of the plural white keys and the plural black keys and a second key having the distance longer than the distance of the first key have a predetermined rocking angle respectively, the first key and the second key being both white keys or both black keys, a positional relationship between a plane including the key support portion of the first key and the front end of the operation portion of the first key, and the top face of the first key is set in order that the position of the front end of the operation portion of the first key in the vertical direction and in the longitudinal direction is the same as the position of the front end of the operation portion of the second key in the vertical direction and in the longitudinal direction, and the top face of the first key is in plane with the top face of the second key.

2. The keyboard device according to claim 1, wherein the key support portion of the first key is located below a reference plane including the key support portion of the second key and the front end of the second key in the state in which the second key is released, and when the first key and the second key are released, the front end of the operation portion of the first key is located posterior to the front end of the operation portion of the second key.

3. The keyboard device according to claim 1, wherein the distance between the plane including the edge line of the first key and the key support portion of the first key is set to be the same as the distance between the plane including the edge line of the second key and the key support portion of the second key.

4. The keyboard device according to claim 1, wherein the positions of the key support portions of the first key and the second key are set to be the same.

5. The keyboard device according to claim 1, wherein the first key and the second key are adjacent white keys, and the edge line of the black key between the first key and the second key is located between the top face of the first key and the top face of the second key, in a state in which the first key, the second key, and the black key are released.

6. The keyboard device according to claim 1, wherein the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted.

7. The keyboard device according to claim 1, wherein the distance from the leading end to the hammer support portion of the plural hammers is the same for all of the plural hammers.

8. The keyboard device according to claim 7, wherein each of the plural hammers includes a mass member that becomes light from a low-pitched side toward a high-pitched side, and a key touch feeling becomes gradually light from the low-pitched side toward the high-pitched side.

9. The keyboard device according to claim 8, wherein the mass member for the hammer for the white key in the plural hammers is heavier than the mass member for the neighboring hammer for the black key.

10. The keyboard device according to claim 1, wherein the length from the front end to the back end of the plural white keys becomes shorter toward the high-pitched side from the low-pitched side, and the length from the front end to the back end of the plural black keys becomes shorter toward the high-pitched side from the low-pitched side.

* * * * *